United States Patent [19]

Hansen et al.

[11] 4,106,883

[45] Aug. 15, 1978

[54] DISTRIBUTING VALVE ON A HYDRAULIC ROTARY PISTON ENGINE

[75] Inventors: Gunnar Lyshøj Hansen, Nordborg; Leif Viggo Sturlason, Sonderborg, both of Denmark

[73] Assignee: Danfoss A/S, Nordborg, Denmark

[21] Appl. No.: 771,979

[22] Filed: Feb. 25, 1977

[30] Foreign Application Priority Data

Mar. 4, 1976 [DE] Fed. Rep. of Germany ..... 2608887

[51] Int. Cl.[2] ..... F04C 15/02

[52] U.S. Cl. ..... 418/61 B; 137/625.24

[58] Field of Search ..... 418/61 B; 251/209; 137/625.13, 625.15, 625.18, 625.2, 625.23, 625.24

[56] References Cited

U.S. PATENT DOCUMENTS

| | | | |
|---|---|---|---|
| 3,473,437 | 10/1969 | Ohrberg | 418/61 B |
| 3,516,437 | 6/1970 | Folkerts | 137/625.23 |

*Primary Examiner*—Carlton R. Croyle
*Assistant Examiner*—Leonard Smith

[57] ABSTRACT

The invention relates to an expansible chamber rotary piston engine of the type having meshing internal and external gears wherein one rotatable gear, which may be an internal gear or an external gear, has rotatable and oribtal movement relative to the other gear which is fixed relative to the housing. The engine has relatively rotatable and cooperable valve members connected respectively to the gears. The cooperable surfaces between the valve members may be either flat or cylindrically shaped. The valve members have respective first and second sets of circumferentially arranged ports with each port in one set moving sequentially into alignment with each port in the other set during relative rotation of the valve members. The ports are generally rectangularly shaped to provide maximum flow capacity between the valve members. In order to prevent the initial port overlap rate from being too high when two ports move into alignment, the edges of one set of ports is orientated at a small angle relative to the edges of the other set of ports. In this way the initial part of the overlapping is at a relatively slower rate and the impact effect of full pressure in the expanding chambers of the engine is minimized.

2 Claims, 7 Drawing Figures

DISTRIBUTING VALVE ON A HYDRAULIC ROTARY PISTON ENGINE

The invention relates to a distributing valve on a hydraulic rotary piston engine comprising an externally serrated gear member (gear) and an internally serrated gear member (gear ring) which surrounds same, has one additional tooth and forms displacement cells therewith, wherein two valve members, one fixed to each gear member, co-operate with one another in the manner of a rotary slide along a surface of the cylinder and are there provided with axially extending control orifices which substantially avoid impacts, the control orifices of one valve member each lead by way of a passage to one displacement cell and their number corresponds to the number of teeth of the gear member secured thereto, and the control orifices of the other valve member are connected in alternate sequence to the engine inlet and outlet and their number corresponds to twice the number of teeth of the gear member secured thereto.

In a known distributing valve of this kind, each second longitudinal web between the control orifices is only locally provided with circumferentially diverging bridging incisions of small orifice cross-section and preferably converging in triangular formation. During over-controlling of the leading edge of the control orifices, one prevents in this way the almost impactlike effect of the full pressure in the displacement cells (motor) or the transmission to the system of the pressure produced in the displacement cells (pump). The bridging incisions reduce this sudden opening pulse because the pressure build-up already begins when the bridging incision comes to lie under the opposite orifice. By means of triangular orifices, one can achieve a practically smooth gradual transition instead of a steep pressure rise flank. However, after producing the control orifices by milling or the like, it is necessary to conduct a further machining operation in order to create the bridging incisions.

The invention is based on the problem of providing a distributing valve of the aforementioned kind in which no additional machining is necessary in order substantially to avoid the pressure pulses.

This problem is solved according to the invention in that the control orifices of the one valve member extend at a small angle obliquely to the parallel axis.

When such an oblique control orifice coincides with the control orifice of the other valve having the usual parallel axis, there will not be a sudden but a gradual opening of the flow passage. This is particularly important with the distributing valves with cylindrical rotary slides here in question because otherwise very high pressure peaks would occur by reason of the comparatively large amounts of liquid enclosed in the passages. Even if opening commences before the theoretically correct instant of opening because of the tolerances or for other reasons, this is without danger because the orifice cross-section is so small to begin with that it has a throttling effect and therefore merely results in the reduction of pressure without initiating a function of the engine. Manufacture is very simple because the milling operation is necessary anyway and the milling cutters only have to be guided obliquely.

It is advisable on the one hand not to choose an angle that is too small because otherwise the differences from sudden opening would hardly be noticeable. On the other hand, the angle must not be too large because otherwise difficulties may arise during covering by means of the sealing webs remaining between the other control orifices. An angle that is particularly suitable in practice is about 3° to 8°.

The obliquely extending control orifices can be selectively applied to the one or other valve member, irrespective of whether one is concerned with the internal or external periphery. Simplification of the work is sometimes obtained if the control orifices connected to the displacement cells extend obliquely because this is the lesser amount.

In a further embodiment, the obliquity and width of the control orifices can be dimensioned so that control orifices collected to the displacement cells can be covered substantially accurately by every second of the sealing webs remaining between the other control orifices but more than amply covered by the intermediate sealing webs. In this way the displacement cell having the largest volume is momentarily completely closed during pressure change. The pressure created therein relieves the two adjacent teeth. The build-up and reduction of pressure presents no difficulties because of the gradual transition.

The invention will now be described in more detail with reference to the example shown in the drawing, wherein.

Figure 1:
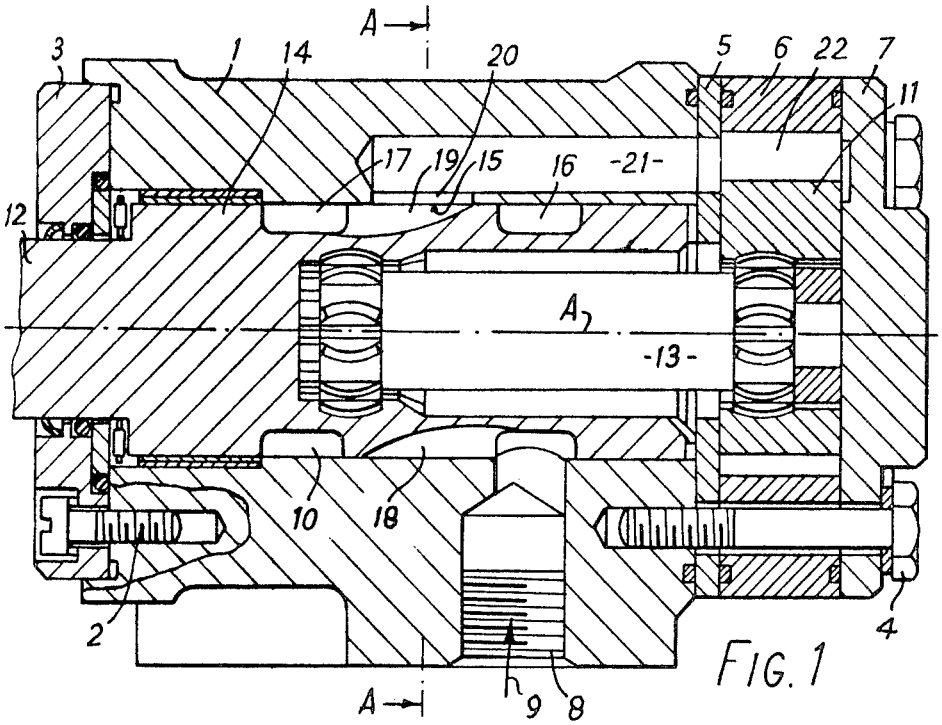
FIG. 1 is a longitudinal section through a rotary piston engine.

A housing 1 carries at one side a cover 3 secured by screws 2 and at the other side an intermediate plate 5 likewise secured by screws 4, an internally serrated gear ring 6 and a cover 7. In the housing 1 there is also provided an inlet opening 8 for the inflowing compressed oil 9 and an outlet opening (not shown) for discharged oil 10.

In mesh with the gear ring 6 there is an externally serrated gear 11 which has on tooth less than the gear ring and the rotary motion of which is superimposed on gyration of its centre of gravity. In order to permit rotation of the gear 11 to be transmitted to a main shaft, a Cardan shaft 13 for balancing out the gyratory movement of the centre of gravity is connected to the gear, its other end engaging in a valve member 14 in the form of a rotary slide which is in one piece with the main shaft 12 and which, along a surface of the cylinder, co-operates with a second valve member 15 formed by the bore of the housing 1.

Two circumferential grooves 16 and 17 are provided in the rotary slide. The circumferential groove 16 constantly communicates with the inlet opening 8 and the circumferential groove 17 constantly communicates with the outlet opening. Alternately provided at the periphery of the rotary slide 14 there are control orifices 18 in the form of grooves communicating with the circumferential groove 16 and control orifices 19 in the form of grooves communicating with the circumferential groove 17. The number of control orifices 18 and 19 in each case corresponds to the number of teeth of the gear 11. In the housing 1 there are control orifices 20 in the form of apertures which are connected by passages 21 to the displacement cells 22 formed between the teeth of the gear and gear ring. Accordingly, the displacement cells 22 are alternately connected to the inlet 9 and the outlet 10 so that continual rotating will result in the case of a motor. Conversely, when power is applied to the shaft 12, the engine works as a pump.

Figure 2:
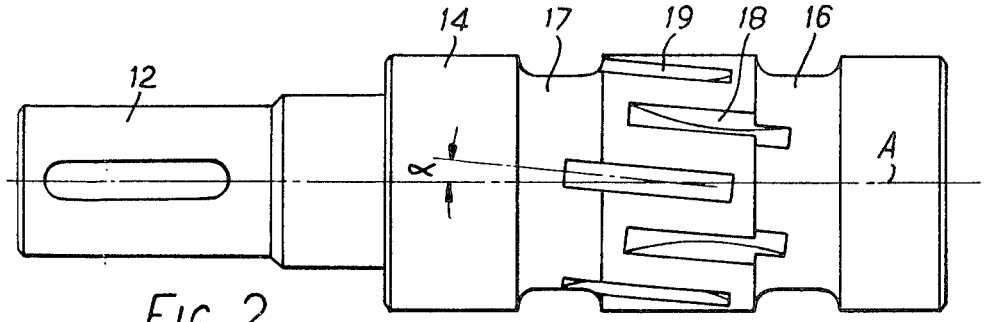
FIG. 2 is a plan view of the rotary slide.

In the FIG. 1 embodiment, the control orifices 20 extend in a direction parallel to the axis. The control orifices 18 and 19, however, are oblique to this parallel axis by an angle $\alpha$. This is particularly evident from the FIG. 2 plan view of the valve member 14. The angle $\alpha$ in this case amounts to about 5°.

Figure 3B:
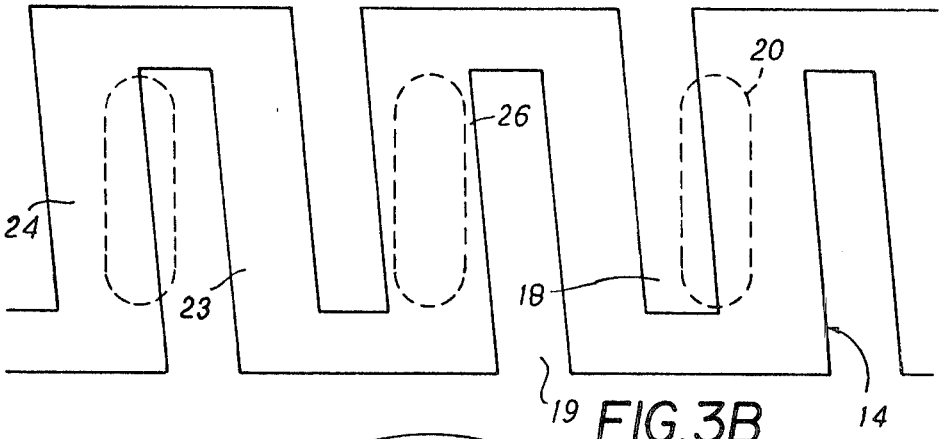
FIGS. 3A and 3B show a development of the rotary slide with the associated position of the gear elements.
Figure 3A:
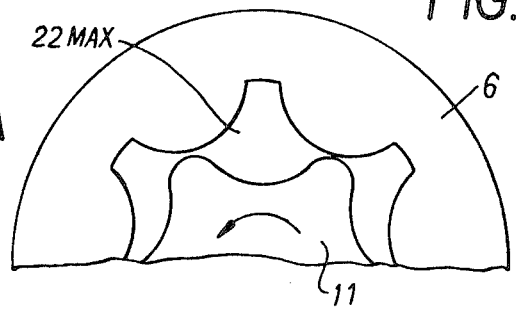
Figure 4B:
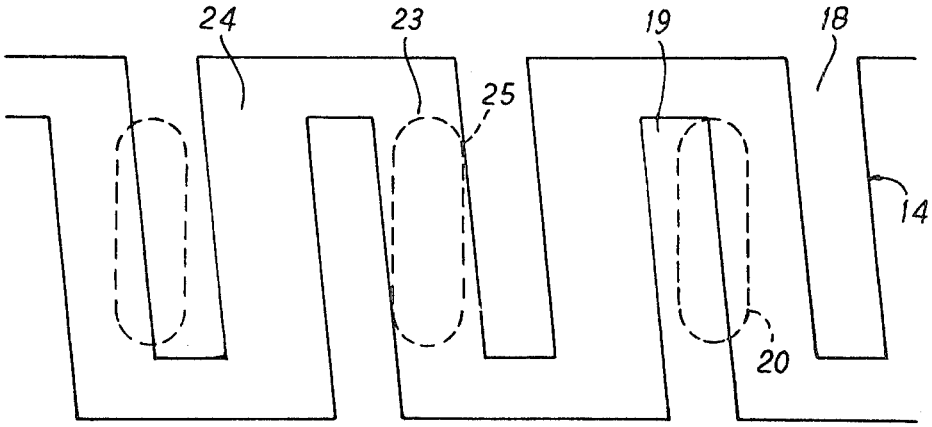
FIGS. 4A and 4B show a similar representation as in FIGS. 3A and 3B but in a different operating position.
Figure 4A:
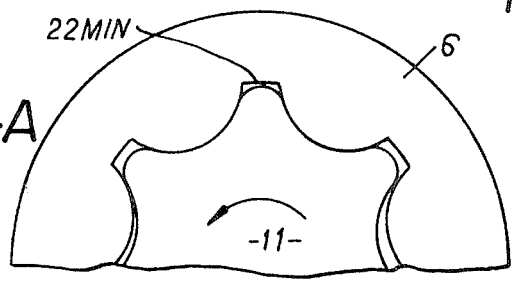

Whereas the control orifices 18 and 19 are of the same size and the control orifices 20 are also all of the same size, a narrower sealing web 23 and a broader sealing web 24 alternately follow one another between the control orifices on the valve member 14. The narrower sealing web 23 is dimensioned for obliquity and width so that it can substantially accurately cover one control orifice 20 as is shown in the middle of FIG. 4. The sealing web 24, on the other hand, is dimensioned so that it more than covers the control orifice 20, as shown in the middle of FIG. 3. The representation of FIGS. 3 and 4 assume that seven displacement chambers 22 are provided which are bonded by a gear ring 6 having seven teeth and a gear 11 with six teeth.

The obliquity of the control orifices 18 and 19 ensures that when overcontrolling the control orifices 20 their entire side edge 25 is not released all at once but such release extends along a path depending on the obliquity. The same applies when closing this control orifice. Consequently, before and after the actual opening a transition cross-section is available which, because of its small size, has a throttling effect and therefore does not yet initiate an engine function but permits a pressure build-up or reduction in the displacement cells 22 and the associated passages 21. Pressure pulses are avoided in this way.

The larger width of the sealing web 24 has the result that, as shown in FIG. 3, the largest displacement cell 22 max at any one time is excessively covered (26) so that this cell is momentarily covered, namely substantially during its reduction phase because of the rotary play between the gear 11 and valve member 14. A build-up in this cell as a result of a change in volume leads to a relief of the tooth crests. This pressure build-up does not detrimentally affect operation because the pressure peak is gradually reduced during the subsequent release of the control orifice 25. As is desired, this effect of occurs only during a pressure change of the largest diplacement cell 22 max but not during a pressure change of the smallest displacement cell 22 min as is shown in FIG. 4.

Figure 5:
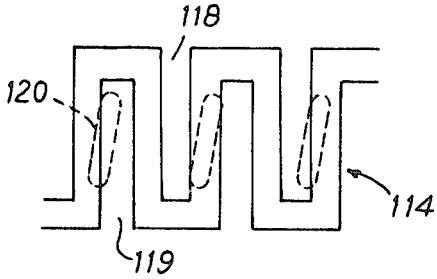
FIG. 5 is a development of a modified embodiment.

FIG. 5 illustrates a modification in which corresponding parts are referred to by reference numberals that are increased by 100. In this case the valve member 114 has control orifices 118 and 119 parallel to the axis whilst the control orifices 120 in the valve member at the side of the housing are oblique. It will be seen that similar effects are achievable in this case.

Nevertheless, the control orifices can be produced in the conventional manner. Oblique grooves can be simply produced by positioning a milling cutter plate obliquely and oblique apertures can be simply produced by positioning a finger milling cutter obliquely.

The use of this principle is not restricted to engines having a fixed gear ring and rotating a gyrating gear connected to the main shaft. In modifications, the gear ring rotates and gyrates. It is also possible to allow one gear element to gyrate and the other to rotate, the last mentioned gear member then being connected to the main shaft.

We claim:

1. An expansible chamber rotary piston engine comprising meshing internal and external gears wherein one rotatable gear has rotatable and orbital movement relative to the other fixed gear to form expansible chamers, relatively rotatable and cooperable valve members connected respectively to said gears, said valve members having respective first and second sets of circumferentially arranged ports with each port in each set being sequentially aligned with each port in the other set upon relative rotation between said valve members, said valve members having cooperating cylindrically shaped surfaces in which said respective sets of ports are formed, the ports in each of said sets having at least one pair of generally parallel edges which are generally normal with respect to the direction of relative motion between said valve members, the ports in said first set having its said parallel edges orientated at the small angle relative to said parallel edges of the ports in the other of said sets, and said first set of ports having the circumferential spacing of the ports thereof alternately equal to and slightly larger than the width of the ports of said second set of ports so that each of said expansible chambers is completely closed off by said valve members upon reaching its largest volume.

2. An expansible chamber rotary piston engine according to claim 1 wherein said small angle ranges from 3° to 8°.

* * * * *